US012674635B2

(12) United States Patent
Beshore

(10) Patent No.: US 12,674,635 B2
(45) Date of Patent: Jul. 7, 2026

(54) FIREARM ACTION MECHANISM

(71) Applicant: Craig Spurgeon Beshore, Glendora, CA (US)

(72) Inventor: Craig Spurgeon Beshore, Glendora, CA (US)

( * ) Notice: Subject to any disclaimer, the term of this patent is extended or adjusted under 35 U.S.C. 154(b) by 0 days.

(21) Appl. No.: 19/198,018

(22) Filed: May 3, 2025

(65) Prior Publication Data

US 2025/0341374 A1 Nov. 6, 2025

Related U.S. Application Data

(60) Provisional application No. 63/643,055, filed on May 6, 2024.

(51) Int. Cl.
*F41A 9/45* (2006.01)

(52) U.S. Cl.
CPC ..... *F41A 9/45* (2013.01)

(58) Field of Classification Search
CPC ..... F41A 9/45; F41A 9/28
See application file for complete search history.

(56) References Cited

U.S. PATENT DOCUMENTS 35,996 A * 7/1862 Doolittle ..... F41A 9/28 42/60
514,490 A * 2/1894 McCullough ..... F41A 9/18 89/33.17
693,965 A * 2/1902 Harrington ..... F41A 9/10 42/33
732,406 A * 6/1903 Goss ..... F41A 9/72 42/60
1,734,852 A * 11/1929 Frampton ..... F41A 9/73 42/71.01
3,747,249 A * 7/1973 Ouellette ..... F41A 9/70 89/33.17
4,422,433 A * 12/1983 Milliman ..... F41A 9/28 124/48
4,739,570 A * 4/1988 Zedrosser ..... F41A 19/06 42/15
5,727,345 A * 3/1998 Sullivan ..... F41A 9/60 42/59
6,745,755 B2 * 6/2004 Piccini ..... F41A 9/73 124/49
6,772,670 B2 * 8/2004 Koursakoff ..... F41A 25/00 89/157

(Continued)

*Primary Examiner* — Michelle Clement
(74) *Attorney, Agent, or Firm* — Bennet K. Langlotz; Langlotz Patent & Trademark Works, LLC

(57) ABSTRACT

A pistol comprising of a frame, a slide operable to reciprocate with respect to the frame, a barrel connected to the slide, with a cylinder defining a plurality of chambers connected to the slide to reciprocate with the slide, and operable to rotate with respect to the slide. The frame defines an ammunition compartment including an upper most ammunition position. The cylinder has a first chamber registered with the barrel, and a second chamber registered with the upper most ammunition position, such that in response to a cartridge in the first chamber discharging, the slide reciprocates to a recoil position to eject the cartridge case and to cause the upper most cartridge to enter the second chamber. In response to return of the slide to battery, the cylinder rotates to register the second chamber and cartridge, to alignment with the barrel for subsequent discharge.

1 Claim, 11 Drawing Sheets

(56) References Cited

U.S. PATENT DOCUMENTS

| | | | | |
|---|---|---|---|---|
| 7,194,834 | B2 * | 3/2007 | Falenwolfe | F41A 9/38 42/65 |
| 7,765,997 | B2 * | 8/2010 | Klockener | F41B 11/723 124/48 |
| 9,335,116 | B1 * | 5/2016 | Wei | F41A 9/68 |
| 9,664,475 | B1 * | 5/2017 | Maggiore | F41B 11/54 |
| 10,794,649 | B2 * | 10/2020 | Liu | F41F 1/08 |
| 10,941,994 | B2 * | 3/2021 | Shipley | F41A 3/36 |
| 10,955,206 | B2 * | 3/2021 | Wood | F41A 9/45 |

* cited by examiner

FIREARM ACTION MECHANISM

CROSS-REFERENCE TO RELATED APPLICATIONS

This application claims the benefit of U.S. Provisional Patent Application No. 63/643,055, filed on May 6, 2024, entitled "AUTOMATIC ACTION MECHANISM FOR FIREARM", which is hereby incorporated by reference in its entirety for all that is taught and disclosed therein.

FIELD OF THE TECHNOLOGY

The present disclosure relates to firearms, namely actions.

BACKGROUND AND SUMMARY

One of the goals of the disclosure is to reduce the thickness and weight of a handgun. That portion above the hand is most important, as it is part of the target picture. As such it can hide a part of the target that may be critical to shooting decisions. The minimum thickness of a handgun is of course set by the outside diameter of the barrel chamber. Many current automatic pistols have a width of nearly twice this size. The system they function on is called delayed blowback. This is due to the slide also serving as ballast to delay the opening of the chamber when firing a bullet. Extra size, recoil spring resistance and weight are purposely added to aid in this function.

The above disadvantages are addressed by a pistol comprising of a frame, a slide operable to reciprocate with respect to the frame, a barrel connected to the slide, with a cylinder defining a plurality of chambers connected to the slide to reciprocate with the slide, and operable to rotate with respect to the slide. The frame defines an ammunition compartment including an upper most ammunition position. The cylinder has a first chamber registered with the barrel, and a second chamber registered with the upper most ammunition position, such that in response to a cartridge in the first chamber discharging, the slide reciprocates to a recoil position to eject the cartridge case and to cause the upper most cartridge to enter the second chamber. In response to return of the slide to battery, the cylinder rotates to register the second chamber and cartridge, to alignment with the barrel for subsequent discharge.

DETAILED DESCRIPTION OF A PREFERRED EMBODIMENT

Figure 1:
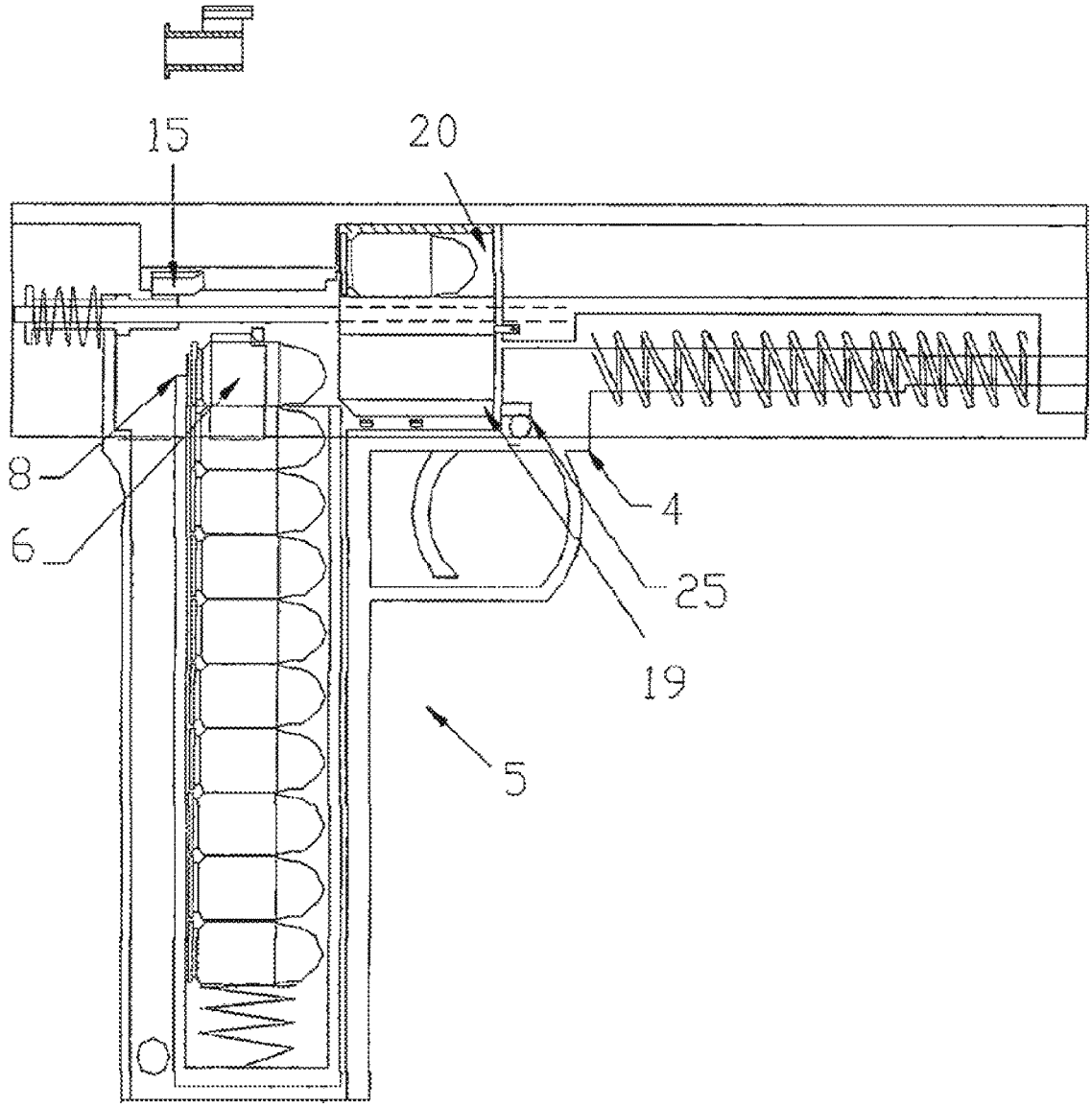
FIG. 1 depicts a side view of the preferred embodiment of the disclosure.
Figure 2:
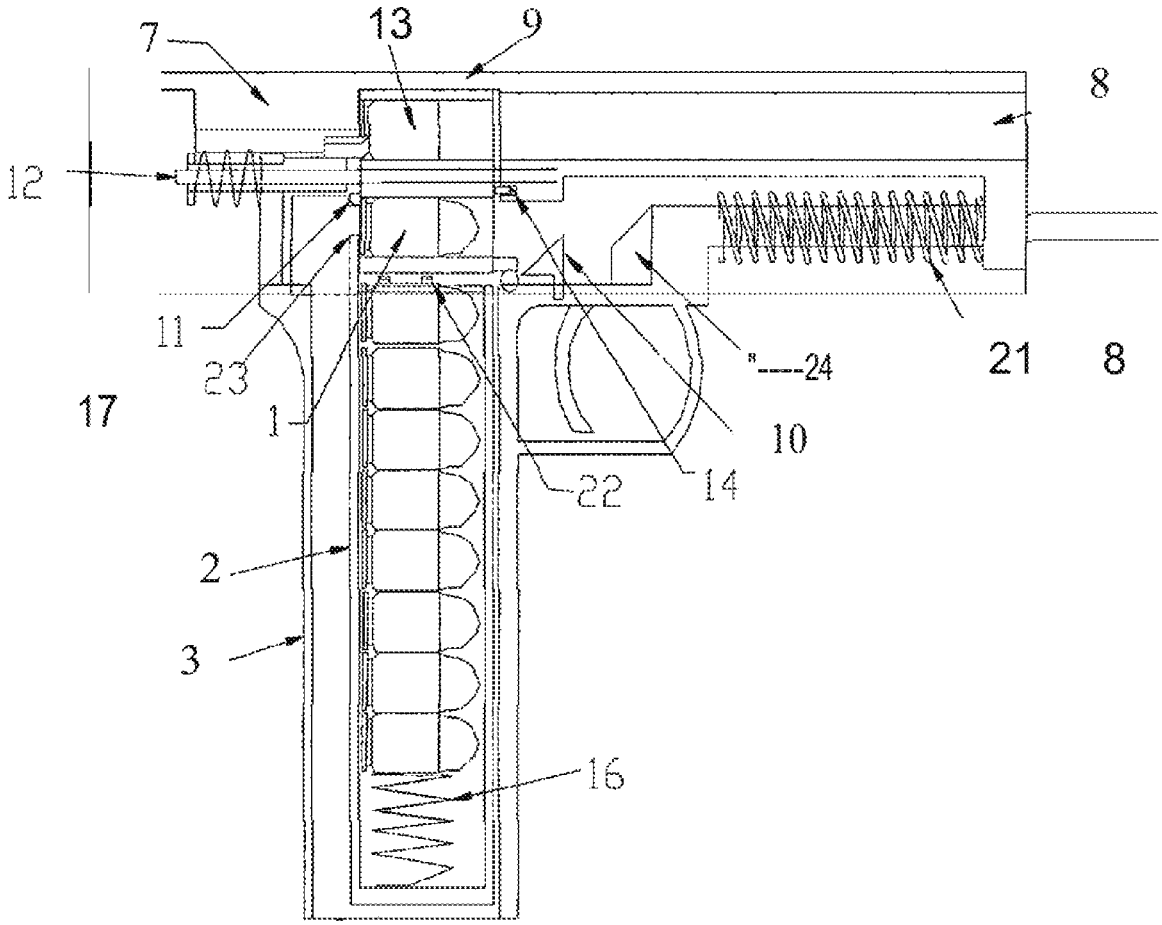
FIG. 2 depicts a side view of the preferred embodiment of the disclosure.
Figure 3:
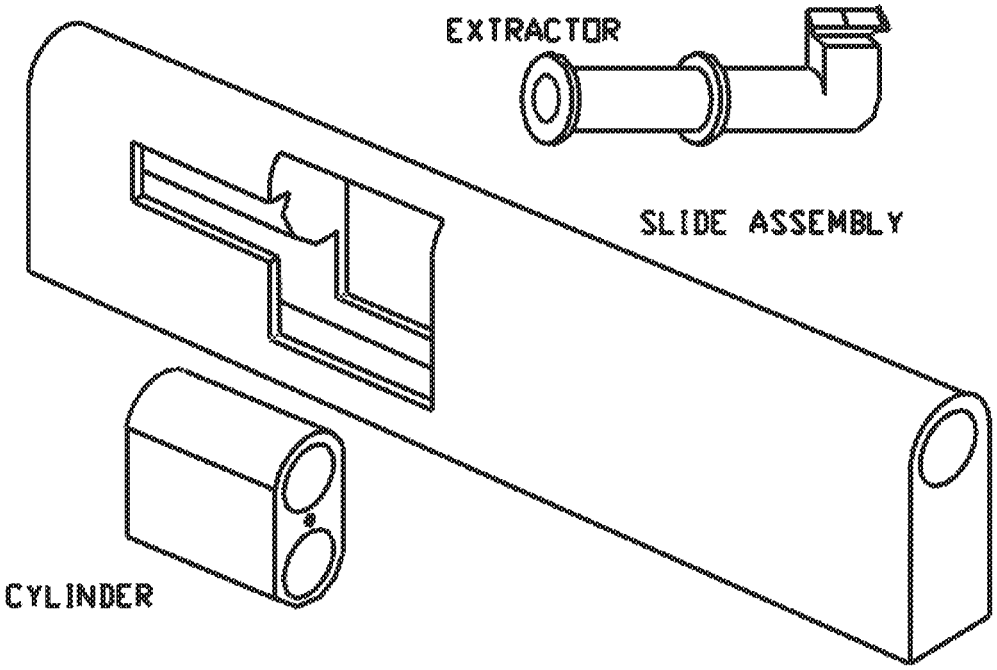
FIG. 3 depicts a view of the rotating mechanism, as it appears when detached from the firearm.
Figure 4:
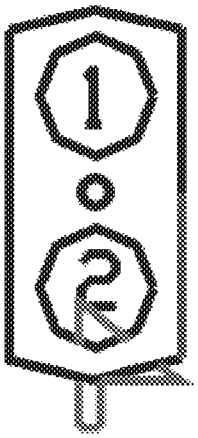
FIG. 4 depicts a view of the rotating mechanism, as it appears when detached from the firearm.
Figure 5A:
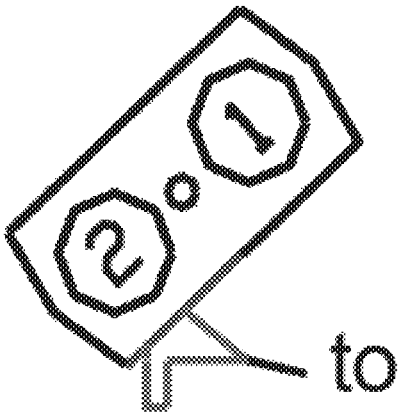
FIG. 5A depicts a view of the rotating mechanism, as it appears when detached from the firearm.
Figure 5B:
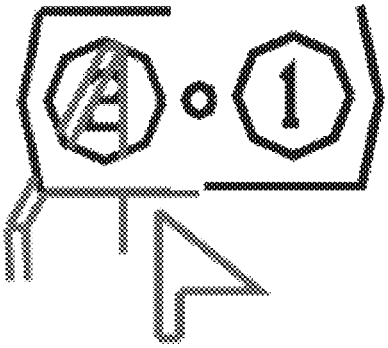
FIG. 5B depicts a view of the rotating mechanism, as it appears when detached from the firearm.
Figure 6:
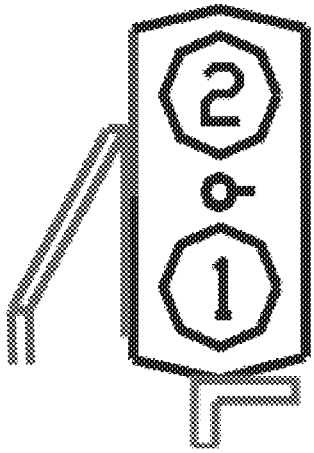
FIG. 6 depicts a view of the rotating mechanism, as it appears when detached from the firearm.
Figure 7:
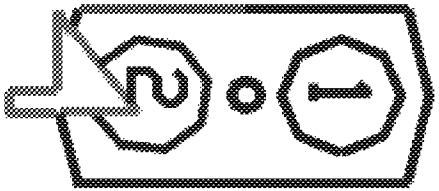
FIG. 7 depicts a view of the rotating mechanism, as it appears when detached from the firearm.
Figure 8:
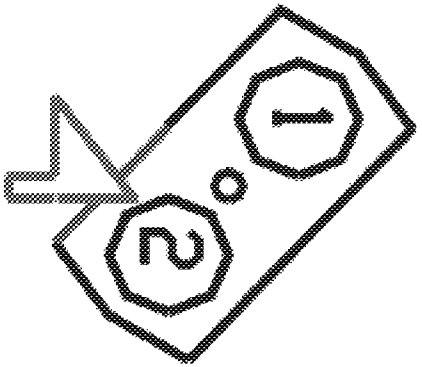
FIG. 8 depicts a view of the rotating mechanism, as it appears when detached from the firearm.
Figure 9A:
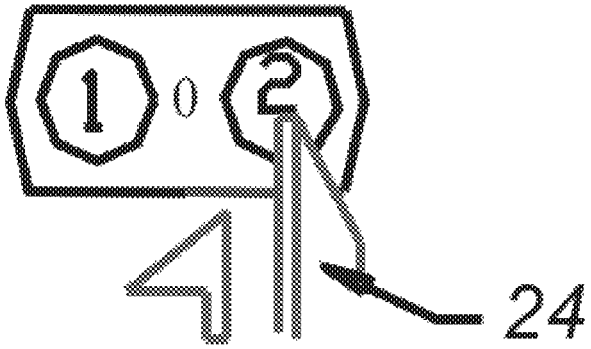
FIG. 9A depicts a view of the rotating mechanism, as it appears when detached from the firearm.
Figure 9B:
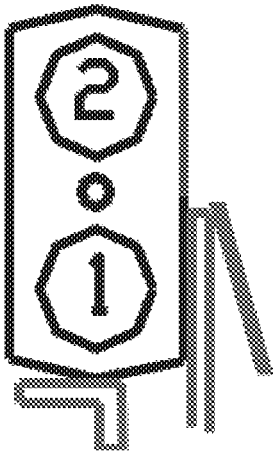
FIG. 9B depicts a view of the rotating mechanism, as it appears when detached from the firearm.

A description of the disclosure is: a handheld frame (4) with a magazine (2) in the handle (3); a one-piece slide/barrel (17) and breach block (7), with space between the two for a cartridge chamber cylinder (20) that is one of at least two chambers of a rotating cylinder (19). Said space is spanned by straps; one at the top (9) connecting the barrel (18) to the chamber block, and two along the bottom connecting the skirt (17) on the barrel to the skirt on the chamber block. Said cylinder (19) has at least two chambers; one aligns with the barrel (18) while a second chamber aligns in front of the uppermost cartridge of the magazine (13).

Upon firing the cartridge in the uppermost chamber, recoil moves the entire slide assembly (17) rearward, to allow said second chamber to enclose and capture said uppermost cartridge (1) of said magazine.

Means are provided (11) to retain said captured cartridge while said slide (17) returns to battery. During said slides return to battery, means (10) (24) are provided to rotate said cylinder.

During said rotation, means are provided for the now empty shell to be ejected from what was the chamber aligned with the barrel, as it becomes the empty chamber and aligns itself in front of the new uppermost cartridge of the magazine.

The previous chamber that captured a new cartridge from said magazine is now aligned with said barrel (18). A firing pin in said breechblock was cocked during the slide travel and the gun is ready to fire again.

Note: Trigger and firing mechanism is not shown in current drawings for clarity. Adequate space is obviously present for either hammer or striker type systems.

A detailed description of action and operation follows:

Cartridges (1) are loaded into magazine (2) to form a stack of cartridges.

Said magazine (2) is shaped to fit the handle (3) of the frame (4) of a pistol (5).

Said magazine has a top piece (6) that is engaged with vertical grooves to the skirt of the slide assembly (8) and thereby slides (10) backward and forward with said skirt/chamber block/barrel assembly (17). This is in addition to horizontal grooves on the lower edge of said top piece that attach said magazine top (6) also in a slide-able way to the sides of said magazine (2). Said top piece (6), together with upward pressure from a spring (16) at the bottom of said magazine, forces the upper most cartridge to stand in a position above the walls of said magazine (2). When said magazine is inserted into said handle (3) and retained by a toggle locking button, said magazine top piece (6) interlocks by vertical ridge and groove with the slide assembly (17), thus synchronizing its' backward and forward motion with the motion of the slide assembly.

Whether the slide is pulled back to manually load the gun, or recoils due to the discharge of a cartridge in the upper chamber of the cylinder aligned with the barrel, the cylinder does not rotate on backward recoil motion. It is forced to travel straight back by the cylinder stop pin (25), located on the skirt that extends from the barrel.

As the slide assembly moves backward, the magazine top piece (6) moves back with the slide (17) due to the vertical interlocks on the slide. When backward motion is the result of discharge, the blast blocker (14) directs side blast away from a downward direction that could otherwise strike the user's hand.

The cylinder stop pin (25) insures the cylinder travels straight back, which in turn ensures engagement of the extractor (15) on to the rim of the empty shell in the upper chamber (13). The slide has a button (25) that forces the cylinder stop pin out of the cylinder as it nears full recoil.

The cylinder is stabilized by the extractor (15) latched onto the empty shell (13). The extractor (15) is supported by the frame. The axle (12) that supports the cylinder passes through the extractor, stabilizing both parts. The extractor has a claw that latches onto the rim of the cartridge. It can move forward and rotate sufficiently to allow said cartridge to be pulled from the cylinder, after it has rotated sufficiently to clear the chamber block (7). Said movement is limited by stops on the body of the extractor striking the frame. It is also spring loaded, which returns it to a home position that enables latching onto the rim of the next fired cartridge.

The axle for the cylinder passes through the center of the extractor, aligning the circular travel of both, so said claw does not lose its grip on said cartridge rim. Said cylinder must travel straight back on recoil and rotate on return to battery.

As backward motion continues, the empty lower chamber of the cylinder (19) captures (encloses) the uppermost cartridge of the magazine. A magazine backstop extension (8) presses the back of the cartridge to facilitate keeping the cartridge in the cylinder. Keeping the captured cartridge in place is needed for a short time until the cylinder has rotated a few degrees. At that time the end wall of the opening that the cylinder is rotating in will trap the cartridge as well, as it is part of and flush with the breech block all of which will keep said cartridge in said cylinder.

Lips protruding from the inner sides of the slide are holding the next cartridge in the magazine in place. The cylinder rotation cam (10), which is spring mounted in the frame, pops up and causes the cylinder to rotate approximately 90 degrees to the left. In this position the cylinder will strike a second cam edge (24) fixed to the frame that will guide the cylinder to rotate 180 degrees upon returning to battery Alternatively, the cylinder axle can serve as a spiral ratcheting mechanism. (Not shown.) The firing system (not shown) can be striker or hammer fired.

The recoil spring (21) is now compressed, and the slide strikes the frame, stopping rearward motion. Under pressure from the recoil spring the skirt/barrel/breach block assembly (8) reverses direction and begins its' return to battery.

Forward motion begins. The now empty shell cannot be extracted until the cylinder rotates to a position where the breech blocker (14) is not blocking it. The return spring on the shell extractor (36) is in both extension and twist load. This creates pulling tension on the shell, which continues until the cylinder rotates enough that the shell is not blocked by the breech blocker. At that point rearward motion by the extractor and forward motion by the cylinder will remove the empty shell from the cylinder chamber. Cylinder rotation is caused by the cylinder rotation cam (34), which snaps diagonally across the forward path of the cylinder when the cylinder is at full recoil.

Upon return the cylinder follows the upper edge of the primary cam to approximately 60 degrees of roll, at which point it rolls over the secondary cam (24) and follows the inner edge of said cam. The cylinder comes to rest parked flush with the inside wall of the secondary cylinder rotation cam (34), this assures position alignment with the barrel.

As the cylinder reaches maximum forward position (battery) the cylinder stop pin (33) is inside the stop pin slot in the cylinder. The recoil spring is keeping the slide assembly in battery, ready to fire.

I claim:

1. A pistol comprising: a frame; a slide operable to reciprocate with respect to the frame; a barrel connected to the slide; a cylinder defining a plurality of chambers connected to the slide to reciprocate with the slide and operable to rotate with respect to the slide; the frame defining an ammunition compartment including an upper most ammunition position; the cylinder having a first chamber registered with the barrel and a second chamber registered with the upper most ammunition position, such that in response to a cartridge in the first chamber discharging, the slide reciprocates to a recoil position to eject a cartridge case and to cause an upper most cartridge to enter the second chamber, and in response to return of the slide to battery the cylinder rotates to register the second chamber and the upper most cartridge to alignment with the barrel for subsequent discharge.

* * * * *